US007021629B1

(12) United States Patent
McCabe

(10) Patent No.: US 7,021,629 B1
(45) Date of Patent: Apr. 4, 2006

(54) WORD-FORMING GAME FOR AT LEAST TWO PLAYERS AND APPARATUS THEREFORE

(76) Inventor: James N. McCabe, P.O. Box 86, Paloma, IL (US) 62359-0086

( * ) Notice: Subject to any disclaimer, the term of this patent is extended or adjusted under 35 U.S.C. 154(b) by 185 days.

(21) Appl. No.: 10/634,980

(22) Filed: Aug. 5, 2003

(51) Int. Cl.
*A63F 3/00* (2006.01)

(52) U.S. Cl. ..... 273/274; 273/299; 434/172

(58) Field of Classification Search ..... 273/272, 273/299, 146; 434/167, 171, 172
See application file for complete search history.

(56) References Cited

U.S. PATENT DOCUMENTS 1,354,910 A * 10/1920 Ketchum ..... 434/172
2,982,031 A * 5/1961 Bardelli ..... 434/172
3,640,531 A 2/1972 Penders
4,084,816 A 4/1978 Shafer
4,171,815 A 10/1979 Sturtz
4,741,538 A 5/1988 Lewis
4,773,651 A 9/1988 Papapavlou
5,145,183 A 9/1992 Gates
5,429,371 A 7/1995 Bledsoe
5,524,899 A * 6/1996 Haqedorn ..... 273/299
6,030,225 A * 2/2000 Chan ..... 434/159

* cited by examiner

*Primary Examiner*—William M. Pierce
(74) *Attorney, Agent, or Firm*—Richard L. Miller, P.A.

(57) ABSTRACT

A word-forming game for at least two players that includes twenty-eight aligned playing pieces. Each playing piece has front and rear indicia thereon that includes an uppercase letter and a corresponding lowercase letter therebelow. The front and rear indicia of a first and twenty-eight playing pieces is a "star," while the front indicia of a second to a twenty-seventh playing piece are each respective letters of the alphabet in alphabetical order and the rear indicia of the second to the twenty-seventh playing pieces are each also respective letters of the alphabet, but in reverse alphabetical order. The method of playing the word-forming game includes making as many words as possible from the twenty-eight playing pieces, removing the associated letters therefrom each time a word is made. The last player to be able to make a word is the winner.

1 Claim, 8 Drawing Sheets

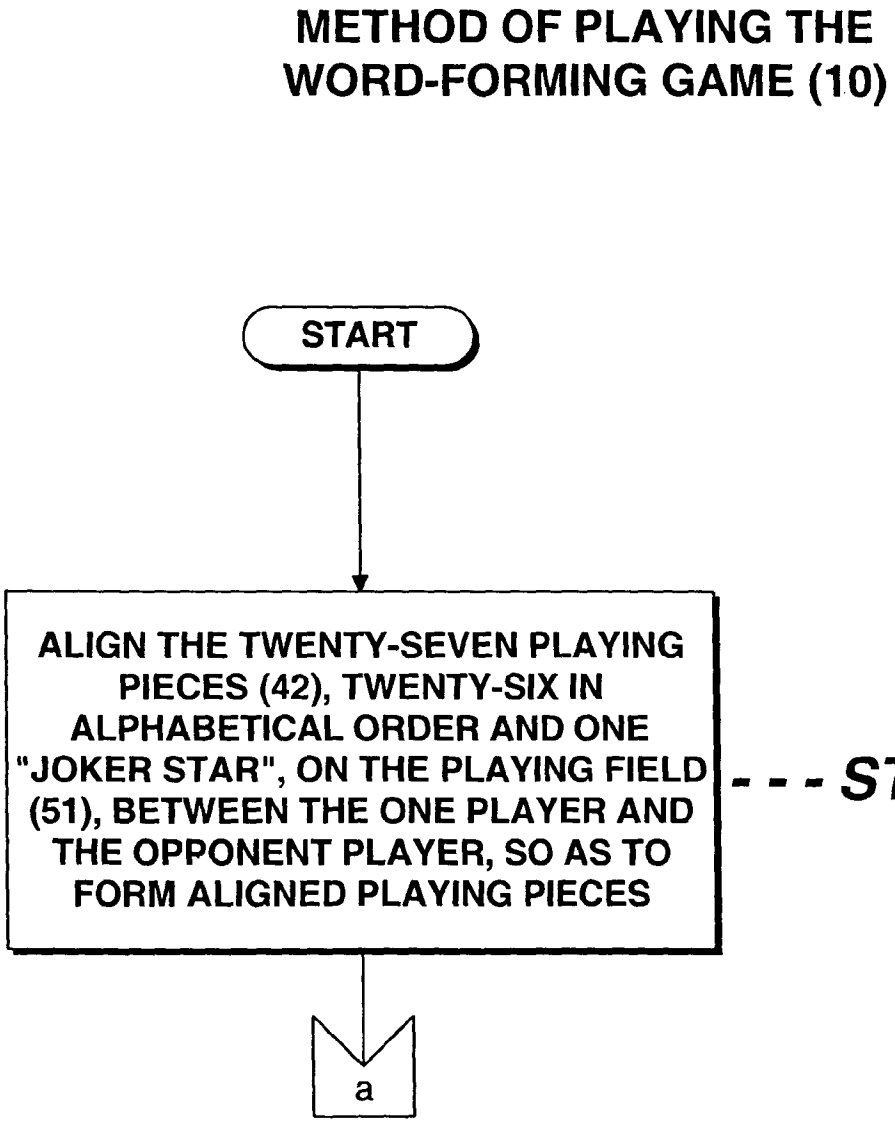
FIG. 31-A

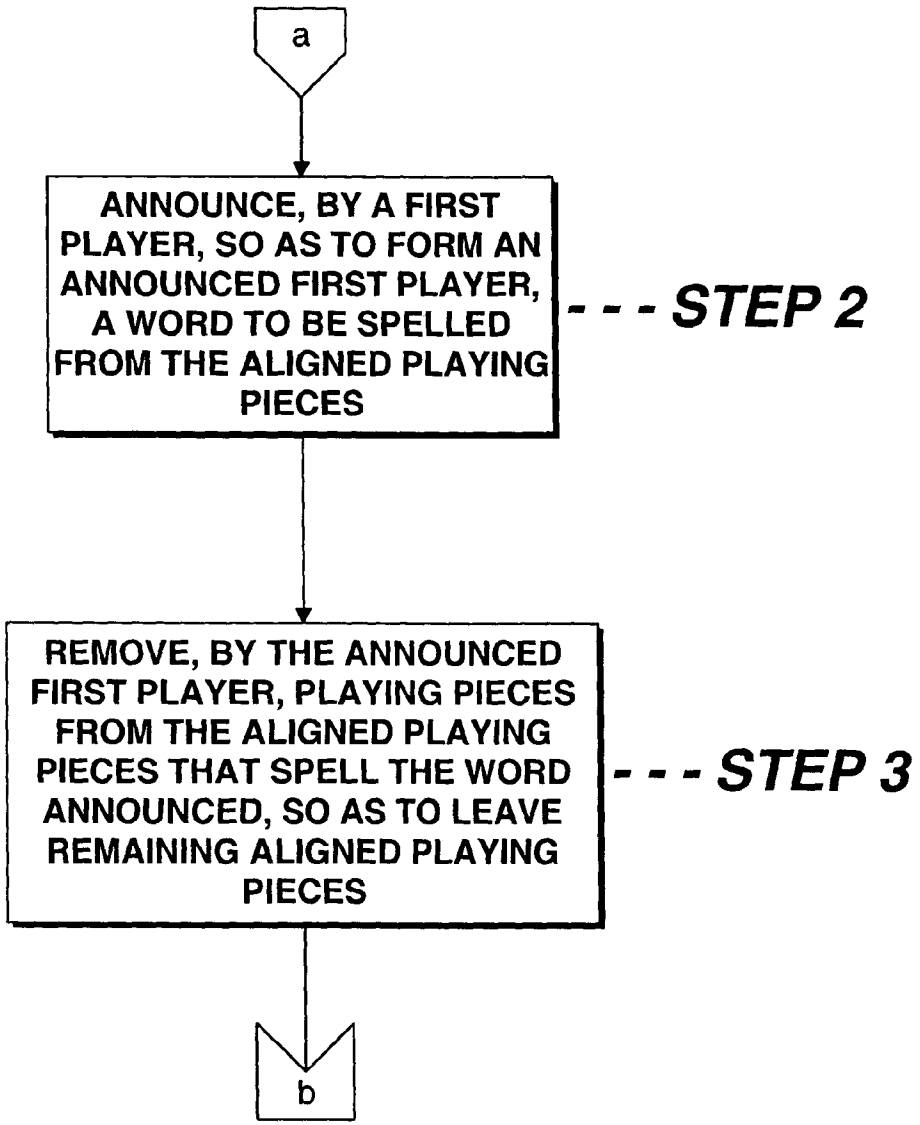
FIG. 31-B

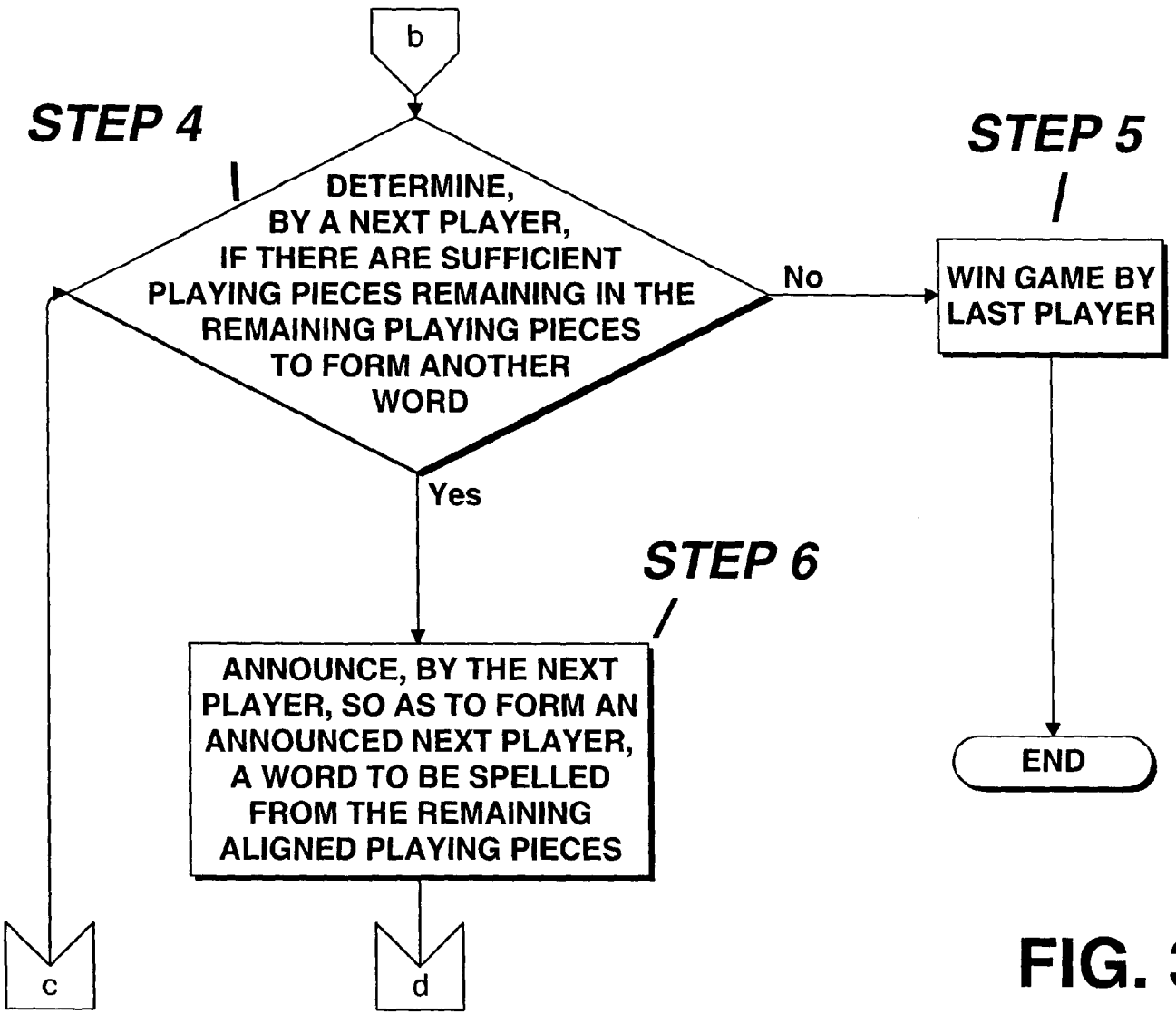
FIG. 31-C

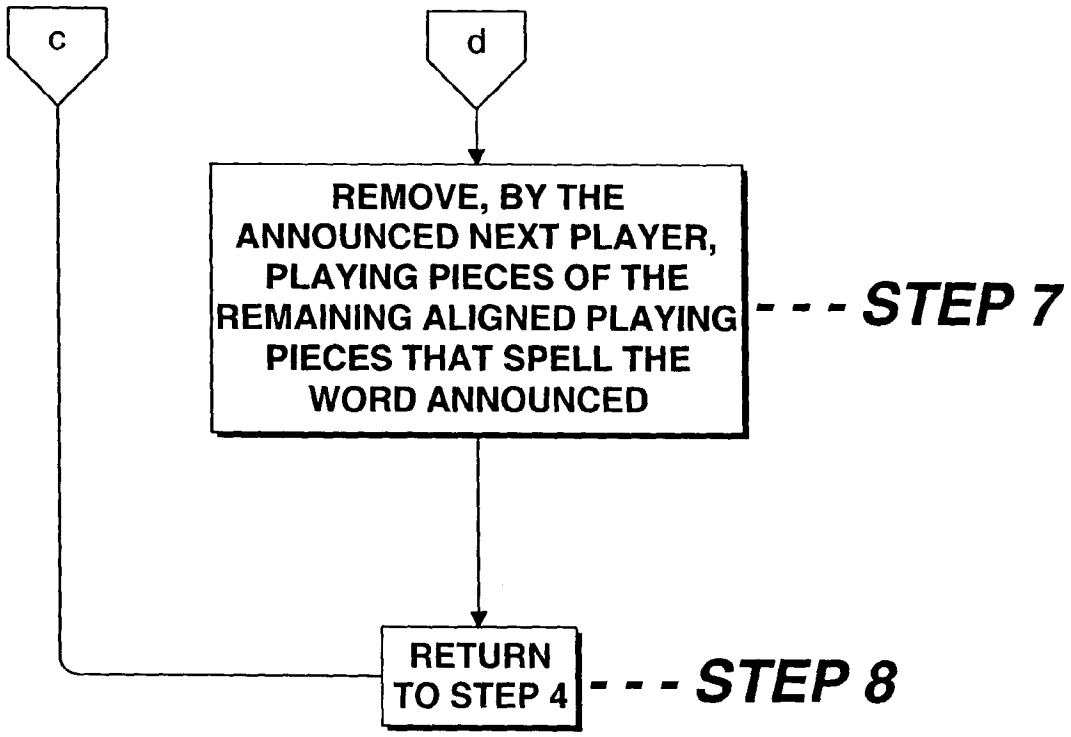
FIG. 31-D

WORD-FORMING GAME FOR AT LEAST TWO PLAYERS AND APPARATUS THEREFORE

CROSS REFERENCE TO RELATED APPLICATIONS

The instant application contains subject matter disclosed in applicant's Design application No. 29/175,143 filed on Jan. 29, 2003, which is presently copending and accordingly it is respectfully requested that this application be accorded the above priority date of Jan. 29, 2003 for any common matter, under Title 35 USC 120.

BACKGROUND OF THE INVENTION

1. Field of the Invention

The present invention relates to a game. More particularly, the present invention relates to a word-forming game for at least two players and apparatus therefor.

2. Description of the Prior Art

Numerous innovations for word games have been provided in the prior art that will be described. Even though these innovations may be suitable for the specific individual purposes to which they address, however, they differ from the present invention.

A FIRST EXAMPLE, U.S. Pat. No. 3,640,531 to Penders teaches a word forming game device that includes a board having a playing surface and a rotor disposed thereover. The playing surface is marked with seven concentric circles connected by 32 radial lines to form 192 segmental spaced in 32 radially disposed groups or sectors of six each and in six circumferential groups or concentric rings of 32 each. The spaces in the outermost ring severally have numerical symbols arranged in numerical sequence to designate the corresponding radial groups therebelow, while the spaces in the remaining rings severally have specific alphabetical letter symbol or a "WILD" word symbol designating any desired letter, but normally do not form words either radially or circumferentially, and the spaces in the outermost ring severally are provided with upstanding stops along the radial lines. The rotor is in the form of a circular disc covering all but the outermost ring of spaces and provided with a sector-shaped slot rotatable to expose upon stopping all five spaces in each of the radial groups, but only four spaces in each of the five concentric circumferential groups, totaling 20 letter symbols and/or "WILD" symbols. A radial group of letter symbols is provided along each side of the slot in alignment with the exposed circumferential groups and spelling one or more words radially inwardly, such as the word "WHEEL" on one side and the words "A WORD" on the other side, to designate the preferred radially inward sequence of selecting the symbols in each of the five circumferential groups upon successive rotations and stops of the rotor, which also is provided along the side of the slot designated by the work "WHEEL" with a detent extending beyond the rotor periphery and engageable with the stops to stop the rotor between adjacent pairs of stops to positively designate the first symbols of the circumferential groups to be selected sequentially radially inwardly. As the rotor stops upon successive rotations, the four symbols in each of the five exposed circumferential groups are selected by each player until all 20 symbols are selected to form words by the use of playing pieces having corresponding symbols.

A SECOND EXAMPLE, U.S. Pat. No. 4,084,816 to Shafer teaches an educational and amusing game for evolving words comprising a plurality of word cards which are provided with two five-letter words having only one vowel combination and in which no one letter of the alphabet is repeated on any one word card. The object of the games is to completely spell out both words on a word card previously chosen by each participant by means of employing games pieces which are provided with letters, complete words, and vowel combinations which duplicate the letters, vowel combinations, and words of the two-word combinations formed on the word cards. The participants randomly draw upon a series of game pieces which selectively aid and/or impede the participants in their task of spelling out the words on a drawn word card.

A THIRD EXAMPLE, U.S. Pat. No. 4,171,815 to Sturtz teaches a word forming game comprising a game board having three peripheral slide and an open side adapted to receive therebetween crossword puzzle inserts. The upper surface of two of the slides are numbered from thirteen to one. The crossword inserts have open squares to be filled in with play pieces marked with various letters to be inserted in the squares to provide definitions for words appearing in the puzzles. Also provided are score sheets to keep track of the players performance. The numbering on the slides also indicates points won by a player for placing the right letters in the correct squares in response to a puzzle question.

A FOURTH EXAMPLE, U.S. Pat. No. 4,741,538 to Lewis teaches a game which includes the board, cards, playing pieces and the rules for playing the game. The basic principle of the game deals mainly with the purchasing of alphabet letters from an alphabet bank for a predetermined price displayed on the surface of the game board. Each player tries to obtain enough alphabet letters to speel out a word while avoiding his opponent's scheme to get his alphabet letters and eliminate his ability to spell out a complete word. Players purchase alphabet letters with play money, and in turn collect a pay-off price for each word. The player that accumulates ten thousand dollars first or eliminates all other players out of the game is the sole winner.

A FIFTH EXAMPLE, U.S. Pat. No. 4,773,651 to Papapavlou teaches a hand of cards bearing letters of the alphabet and a combined scoring and word card are dealt to each player, the players drawing a card from the deck and discarding in turn until one player's letter cards spell the word of his word card, the player then placing the word card in a space adapted to receive it on a score board having graduated spaces for each of the players, and continuing the game until one player has filled the spaces provided for him on the score board.

A SIXTH EXAMPLE, U.S. Pat. No. 5,145,183 to Gates teaches a word-forming game comprising of a game board, game rules, pegged game pieces, word cards, playing pads, a timer, pencils, and a numbered die. Players form words from the letters of the word cards using the pencil and pad provided. Players are awarded points by forming words other players have not formed. Each round consists of drawing of a new word card. The winner is the player who has collected enough points to move his or her game piece to the finish.

A SEVENTH EXAMPLE, U.S. Pat. No. 5,429,371 to Bledsoe teaches a board games that has first and second playing areas, with the first playing area being a continuous path along the perimeter of the game board. The second playing area is located within the first playing area and includes spaces for forming words with the spaces having a surface for erasable markings of letters. The first and second playing areas have indicia printed thereon. The first playing area determines which letters to use to form words within the second playing area, and indicates the monetary values for using the indicated letters. The board game also includes a die that controls the movement of player pieces along the continuous path and which directs the players to use a spinner of the board game. Words may be formed within the second playing area and can be spelled forward, backward, vertically, horizontally or diagonally. The spinner provides a further random chance control.

It is apparent that numerous innovations for word games have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a word-forming game for at two players and apparatus therefor that avoids the disadvantages of the prior art.

ANOTHER OBJECT of the present invention is to provide a word-forming game for at least two players and apparatus therefor that is simple and inexpensive to manufacture.

STILL ANOTHER OBJECT of the present invention is to provide a word-forming game for at least two players and apparatus therefor that is simple to use.

BRIEFLY STATED, STILL YET ANOTHER OBJECT of the present invention is to provide a word-forming game for at least two players that includes twenty-eight aligned playing pieces. Each playing piece has front and rear indicia thereon that includes an uppercase letter and a corresponding lowercase letter therebelow. The front and rear indicia of a first and twenty-eight playing pieces is a "star," while the front indicia of a second to a twenty-seventh playing piece are each respective letters of the alphabet in alphabetical order and the rear indicia of the second to the twenty-seventh playing piece are each also respective letters of the alphabet, but in reverse alphabetical order. The method of playing the word-forming game includes making as many words as possible from the twenty-eight playing pieces, removing the associated letters therefrom each time a word is made. The last player to be able to make a word wins.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIGS. 31A–31D are a process flow chart of the method of playing the game method of the present invention.

LIST OF REFERENCE NUMERALS UTILIZED IN THE DRAWING

Figure 1:
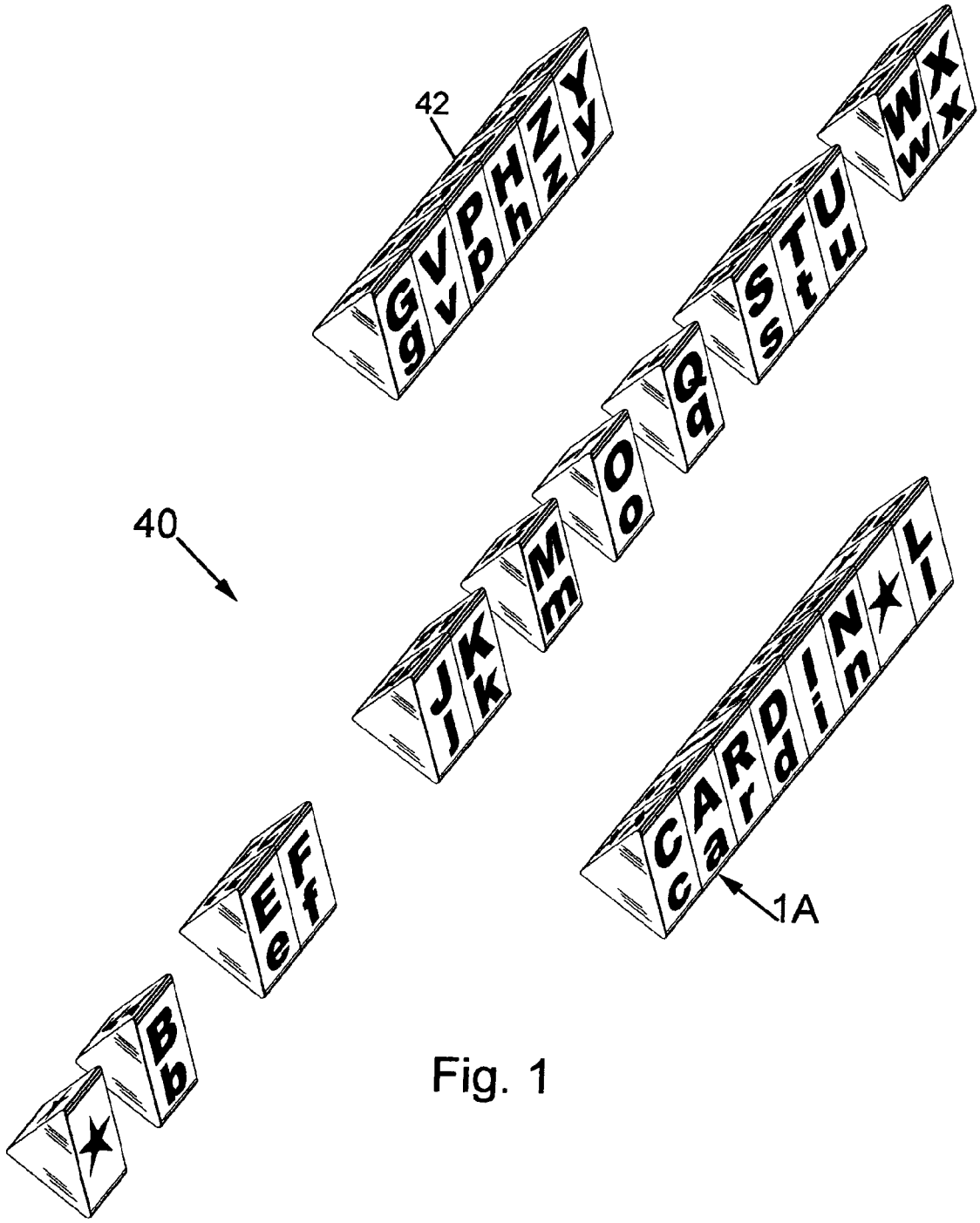
FIG. 1 is a diagrammatic perspective view of the present invention in use.

40 word-forming game of present invention for at least two players (not shown)

42 twenty-eight playing pieces

44 front surface of each playing piece of twenty-eight playing pieces 42 for facing one player (not shown)

46 rear surface of each playing piece of twenty-eight playing pieces 42 for facing another player (not shown)

48 pair of side surfaces of each playing piece of twenty-eight playing pieces 42

50 bottom surface of each playing piece of twenty-eight playing pieces 42 for resting on playing field 51

51 playing field

52 front indicia on front surface 44 of each playing piece of twenty-eight playing pieces 42

54 rear indicia on rear surface 46 of each playing piece of twenty-eight playing pieces 42

56 uppercase letter of each of front indicia 52 and rear indicia 54 of each playing piece of twenty-eight playing pieces 42

58 corresponding lowercase letter of each of front indicia 52 and rear indicia 54 of each playing piece of twenty-eight playing pieces 42

60 first and twenty-eight playing pieces of twenty-eight playing pieces 42

62 "star" of front indicia 52 and rear indicia 54 of first playing piece 60 of twenty-eight playing pieces 42

64 second playing piece of twenty-eight playing pieces 42

66 upper case and lower case "A/a" of front indicia 52 of second playing piece 64 of twenty-eight playing pieces 42

68 upper case and lower case "Z/z" of rear indicia 54 of second playing piece 64 of twenty-eight playing pieces 42

70 third playing piece of twenty-eight playing pieces 42

72 upper case and lower case "B/b" of front indicia 52 of third playing piece 70 of twenty-eight playing pieces 42

73 upper case and lower case "Y/y" of rear indicia 54 of third playing piece 70 of twenty-eight playing pieces 42

74 fourth playing piece of twenty-eight playing pieces 42

76 upper case and lower case "C/c" of front indicia 52 of fourth playing piece 74 of twenty-eight playing pieces 42

78 upper case and lower case "X/x" of rear indicia 54 of fourth playing piece 74 of twenty-eight playing pieces 42

80 fifth playing piece of twenty-eight playing pieces 42

82 upper case and lower case "D/d" of front indicia 52 of fifth playing piece 80 of twenty-eight playing pieces 42

84 upper case and lower case "W/w" of rear indicia 54 of fifth playing piece 80 of twenty-eight playing pieces 42

86 sixth playing piece of twenty-eight playing pieces 42

88 upper case and lower case "E/e" of front indicia 52 of sixth playing piece 86 of twenty-eight playing pieces 42

90 upper case and lower case "V/v" of rear indicia 54 of sixth playing piece 86 of twenty-eight playing pieces 42

92 seventh playing piece 92 of twenty-eight playing pieces 42

94 upper case and lower case "F/f" of front indicia 52 of seventh playing piece 92 of twenty-eight playing pieces 42

96 upper case and lower case "U/u" of rear indicia 54 of seventh playing piece 92 of twenty-eight playing pieces 42

98 eighth playing piece of twenty-eight playing pieces 42

100 upper case and lower case "G/g" of front indicia 52 of eighth playing piece 98 of twenty-eight playing pieces 42

102 upper case and lower case "T/t" of rear indicia 54 of eighth playing piece 98 of twenty-eight playing pieces 42

104 ninth playing piece of twenty-eight playing pieces 42

106 upper case and lower case "H/h" of front indicia 52 of ninth playing piece 104 of twenty-eight playing pieces 42

107 upper case and a lower case "S/s" of rear indicia 54 of ninth playing piece 104 of twenty-eight playing pieces 42

108 tenth playing piece of twenty-eight playing pieces 42

110 upper case and lower case "I/i" of front indicia 52 of tenth playing piece 108 of twenty-eight playing pieces 42

112 upper case and lower case "R/r" of rear indicia 54 of tenth playing piece 108 of twenty-eight playing pieces 42

114 eleventh playing piece of twenty-eight playing pieces 42

116 upper case and lower case "J/j" of front indicia 52 of eleventh playing piece 114 of twenty-eight playing pieces 42

118 upper case and lower case "Q/q" of rear indicia 54 of eleventh playing piece 114 of twenty-eight playing pieces 42

120 twelfth playing piece of twenty-eight playing pieces 42

122 upper case and lower case "K/k" of front indicia 52 of twelfth playing piece 120 of twenty-eight playing pieces 42

123 upper case and lower case "P/p" of rear indicia 54 of twelfth playing piece 120 of twenty-eight playing pieces 42

124 thirteenth playing piece of twenty-eight playing pieces 42

126 upper case and lower case "L/l" of front indicia 52 of thirteenth playing piece 124 of twenty-eight playing pieces 42

128 upper case and a lower case "O/o" of rear indicia 54 of thirteenth playing piece 124 of twenty-eight playing pieces 42

130 fourteenth playing piece 130 of twenty-eight playing pieces 42

132 upper case and lower case "M/m" of front indicia 52 of fourteenth playing piece 130 of twenty-eight playing pieces 42

134 upper case and lower case "N/n" 134 of rear indicia 54 of fourteenth playing piece 130 of twenty-eight playing pieces 42

DETAILED DESCRIPTION OF THE PREFERRED EMBODIMENT

Referring now to the figures, in which like numerals indicate like parts, and particularly to FIG. 1, the word game of the present invention is shown generally at 40 for at least two players (not shown) and comprises twenty-eight playing pieces 42.

Figure 1A:
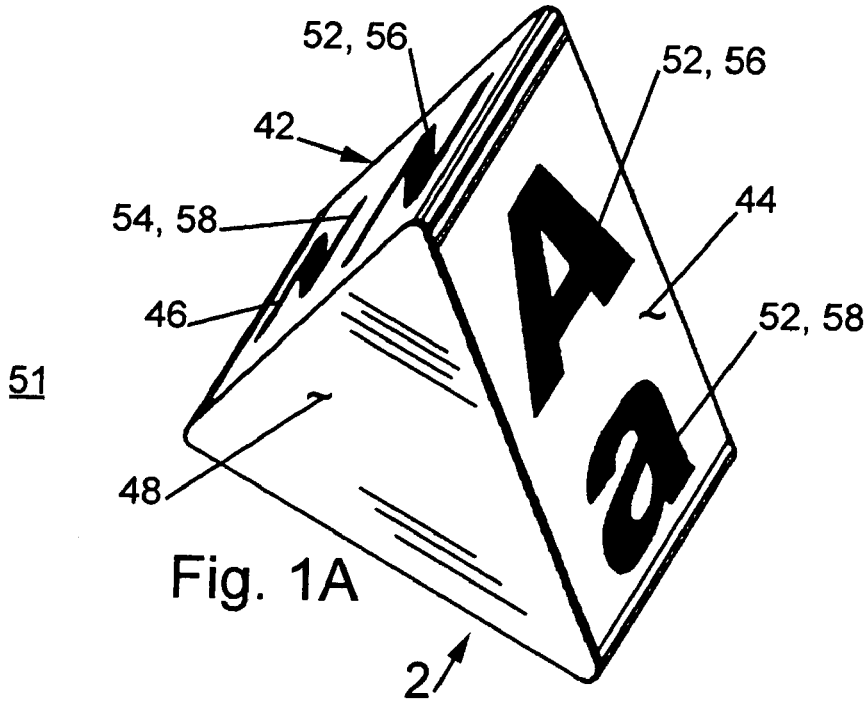
FIG. 1A is an enlarged diagrammatic perspective view of a typical playing piece generally identified by arrow 1A in FIG. 1.
Figure 2:
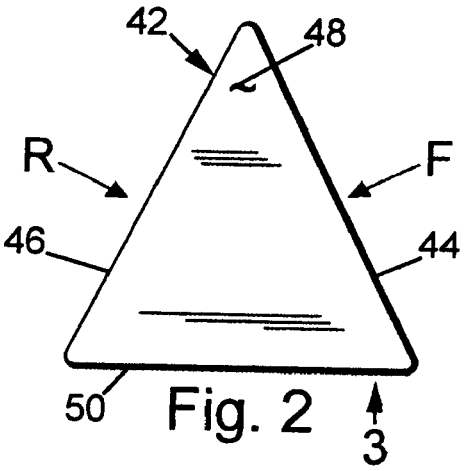
FIG. 2 is a diagrammatic side elevational view taken generally in the direction of arrow 2 in FIG. 1.
Figure 3:
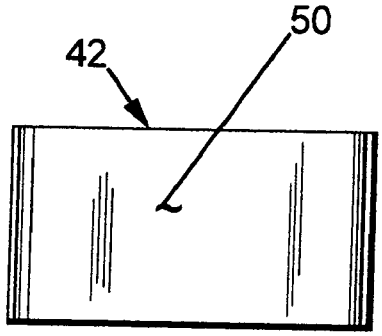
FIG. 3 is a diagrammatic bottom plan view taken generally in the direction of arrow 3 in FIG. 2.

The configuration of a each playing piece 42 can best be seen in FIGS. 1A, 2, and 3, and as such, will be discussed with reference thereto.

Each playing piece 42 has a front surface 44 for facing one player (not shown), a rear surface 46 for facing an opponent player (not shown), a pair of side surfaces 48, and a bottom surface 50 for resting on a playing field 51.

The front surface 44, the rear surface 46, and the bottom surface 50 of each playing piece 42 are each rectangular-shaped, while each of the side surfaces 48 of each playing piece 42 is triangular-shaped and initially abuts against a side surface 48 of an adjacent playing piece 42, while the front surface 44 of each playing piece 42 initially aligns with the front surface 44 of the adjacent playing piece 42, and the rear surface 46 of each playing piece 42 initially aligns with the rear surface 46 of the adjacent playing piece 42.

The front surface 44 of each playing piece 42 has front indicia 52 thereon, while the rear surface 46 of each playing piece 42 has rear indicia 54 thereon.

The front indicia 52 and the rear indicia 54 of each playing piece 42 are letters of the alphabet.

Each of the front indicia 52 and the rear indicia 54 of each playing piece 42 comprises an uppercase letter 56 and a corresponding lowercase letter 58 therebelow.

The specific front indicia 52 and the specific rear indicia 54 of each playing piece of the twenty-eight playing pieces 42 can best be seen in FIGS. 4–30, and as such, will be discussed with reference thereto.

Figure 4:
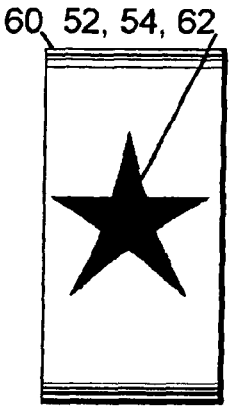
FIG. 4 is a diagrammatic elevational view of first and twenty-eight playing pieces taken generally in the directions of arrows F and R in FIG. 2.
Figure 5:
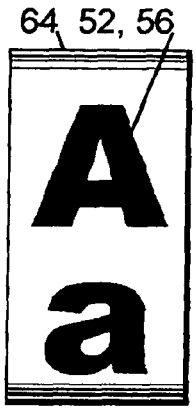
FIG. 5 is a diagrammatic elevational view of a second playing piece taken generally in the direction of arrow F in FIG. 2 and of a twenty-seventh playing piece taken generally in the direction of arrow R in FIG. 2.
Figure 6:
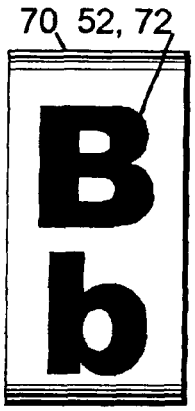
FIG. 6 is a diagrammatic elevational view of a third playing piece taken generally in the direction of arrow F in FIG. 2 and of a twenty-sixth playing piece taken generally in the direction of arrow R in FIG. 2.
Figure 7:
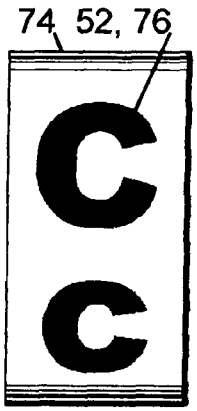
FIG. 7 is a diagrammatic elevational view of a fourth playing piece taken generally in the direction of arrow F in FIG. 2 and of a twenty-fifth playing piece taken generally in the direction of arrow R in FIG. 2.
Figure 8:
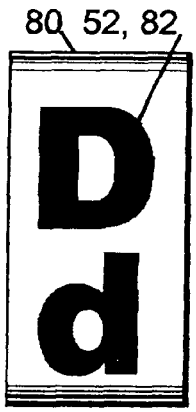
FIG. 8 is a diagrammatic elevational view of a fifth playing piece taken generally in the direction of arrow F in FIG. 2 and of a twenty-fourth playing piece taken generally in the direction of arrow R in FIG. 2.
Figure 9:
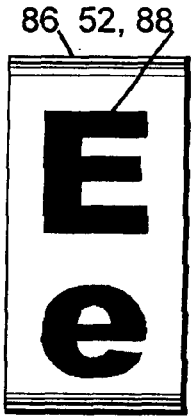
FIG. 9 is a diagrammatic elevational view of a sixth playing piece taken generally in the direction of arrow F in FIG. 2 and of a twenty-third playing piece taken generally in the direction of arrow R in FIG. 2.
Figure 10:
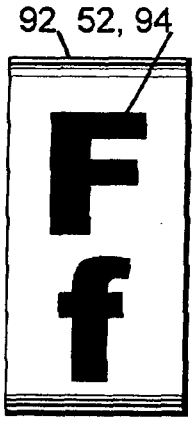
FIG. 10 is a diagrammatic elevational view of a seventh playing piece taken generally in the direction of arrow F in FIG. 2 and of a twenty-second playing piece taken generally in the direction of arrow R in FIG. 2.
Figure 11:
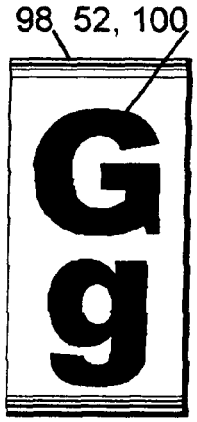
FIG. 11 is a diagrammatic elevational view of a eighth playing piece taken generally in the direction of arrow F in FIG. 2 and of a twenty-first playing piece taken generally in the direction of arrow R in FIG. 2.
Figure 12:
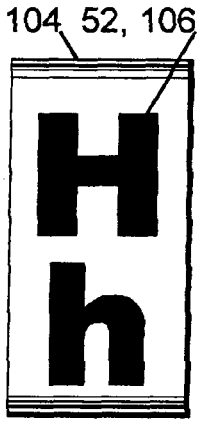
FIG. 12 is a diagrammatic elevational view of a ninth playing piece taken generally in the direction of arrow F in FIG. 2 and of a twentieth playing piece taken generally in the direction of arrow R in FIG. 2.
Figure 13:
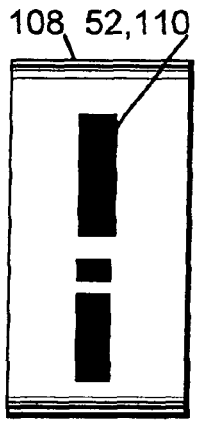
FIG. 13 is a diagrammatic elevational view of a tenth playing piece taken generally in the direction of arrow F in FIG. 2 and of an nineteenth playing piece taken generally in the direction of arrow R in FIG. 2.
Figure 14:
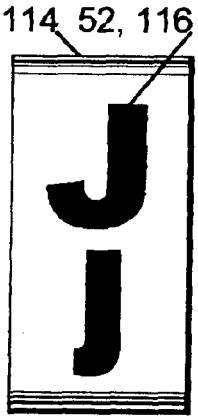
FIG. 14 is a diagrammatic elevational view of a eleventh playing piece taken generally in the direction of arrow F in FIG. 2 and of a eighteenth playing piece taken generally in the direction of arrow R in FIG. 2.
Figure 15:
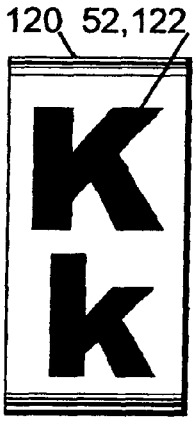
FIG. 15 is a diagrammatic elevational view of a twelfth playing piece taken generally in the direction of arrow F in FIG. 2 and of a seventeenth playing piece taken generally in the direction of arrow R in FIG. 2.
Figure 16:
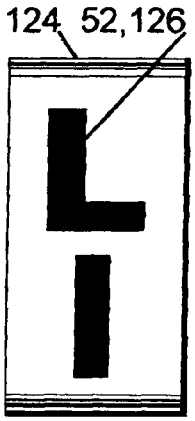
FIG. 16 is a diagrammatic elevational view of a thirteenth playing piece taken generally in the direction of arrow F in FIG. 2 and of a sixteenth playing piece taken generally in the direction of arrow R in FIG. 2.
Figure 17:
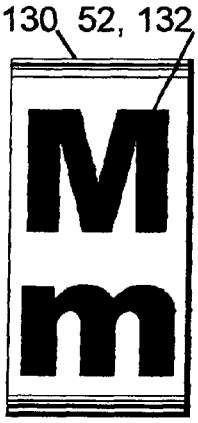
FIG. 17 is a diagrammatic elevational view of a fourteenth playing piece taken generally in the direction of arrow F in FIG. 2 and of the fifteenth playing piece taken generally in the direction of arrow R in FIG. 2.

The front indicia 52 and the rear indicia 54 of a first and twenty-eight playing piece 60 of the twenty-eight playing pieces 42 are each a "star" 62 (FIG. 4).

In general, the front indicia 52 of a second to a twenty-seventh playing piece of the twenty-eight playing pieces 42 are each respective letters of the alphabet in alphabetical order, while the rear indicia 54 of the second to the twenty-seventh playing piece are each also respective letters of the alphabet, but in reverse alphabetical order.

Figure 30:
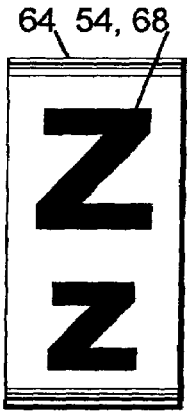
FIG. 30 is a diagrammatic elevational view of a twenty-seventh playing piece taken generally in the direction of arrow F in FIG. 2 and of the second playing piece taken generally in the direction of arrow R in FIG. 2.

The front indicia 52 of a second playing piece 64 of the twenty-eight playing pieces 42 is an upper case and a lower case "A/a" 66 (FIG. 5), while the rear indicia 54 of the second playing piece 64 of the twenty-eight playing pieces 42 is an upper case and a lower case "Z/z" 68 (FIG. 30).

Figure 29:
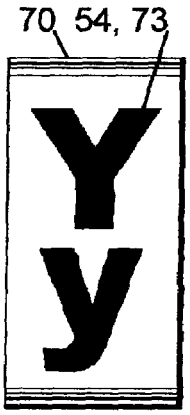
FIG. 29 is a diagrammatic elevational view of a twenty-sixth playing piece taken generally in the direction of arrow F in FIG. 2 and of the third playing piece taken generally in the direction of arrow R in FIG. 2.

The front indicia 52 of a third playing piece 70 of the twenty-eight playing pieces 42 is an upper case and a lower case "B/b" 72 (FIG. 6), while the rear indicia 54 of the third playing piece 70 of the twenty-eight playing pieces 42 is an upper case and a lower case "Y/y" 73 (FIG. 29).

Figure 28:
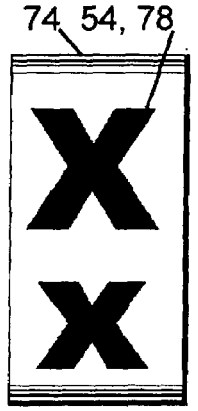
FIG. 28 is a diagrammatic elevational view of a twenty-fifth playing piece taken generally in the direction of arrow F in FIG. 2 and of the fourth playing piece taken generally in the direction of arrow R in FIG. 2.

The front indicia 52 of a fourth playing piece 74 of the twenty-eight playing pieces 42 is an upper case and a lower case "C/c" 76 (FIG. 7), while the rear indicia 54 of the fourth playing piece 74 of the twenty-eight playing pieces 42 is an upper case and a lower case "X/x" 78 (FIG. 28).

Figure 27:
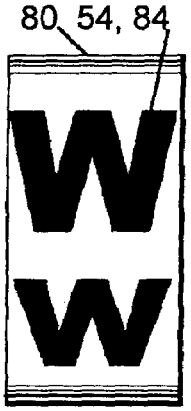
FIG. 27 is a diagrammatic elevational view of a twenty-fourth playing piece taken generally in the direction of arrow F in FIG. 2 and of the fifth playing piece taken generally in the direction of arrow R in FIG. 2.

The front indicia 52 of a fifth playing piece 80 of the twenty-eight playing pieces 42 is an upper case and a lower case "D/d" 82 (FIG. 8), while the rear indicia 54 of the fifth playing piece 80 of the twenty-eight playing pieces 42 is an upper case and a lower case "W/w" 84 (FIG. 27).

Figure 26:
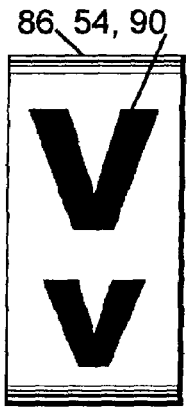
FIG. 26 is a diagrammatic elevational view of a twenty-third playing piece taken generally in the direction of arrow F in FIG. 2 and of the sixth playing piece taken generally in the direction of arrow R in FIG. 2.

The front indicia 52 of a sixth playing piece 86 of the twenty-eight playing pieces 42 is an upper case and a lower case "E/e" 88 (FIG. 9), while the rear indicia 54 of the sixth playing piece 86 of the twenty-eight playing pieces 42 is an upper case and a lower case "V/v" 90 (FIG. 26).

Figure 25:
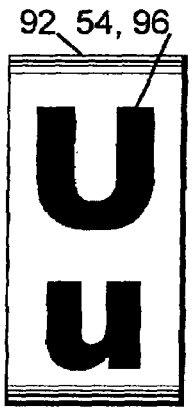
FIG. 25 is a diagrammatic elevational view of a twenty-second playing piece taken generally in the direction of arrow F in FIG. 2 and of the seventh playing piece taken generally in the direction of arrow R in FIG. 2.

The front indicia 52 of a seventh playing piece 92 of the twenty-eight playing pieces 42 is an upper case and a lower case "F/f" 94 (FIG. 10), while the rear indicia 54 of the seventh playing piece 92 of the twenty-eight playing pieces 42 is an upper case and a lower case "U/u" 96 (FIG. 25).

Figure 24:
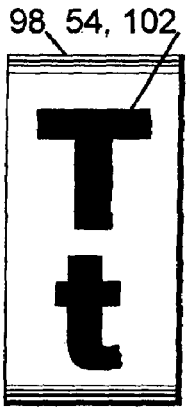
FIG. 24 is a diagrammatic elevational view of a twenty-first playing piece taken generally in the direction of arrow F in FIG. 2 and of the eighth playing piece taken generally in the direction of arrow R in FIG. 2.

The front indicia 52 of an eighth playing piece 98 of the twenty-eight playing pieces 42 is an upper case and a lower case "G/g" 100 (FIG. 11), while the rear indicia 54 of the eighth playing piece 98 of the twenty-eight playing pieces 42 is an upper case and a lower case "T/t" 102 (FIG. 24).

Figure 23:
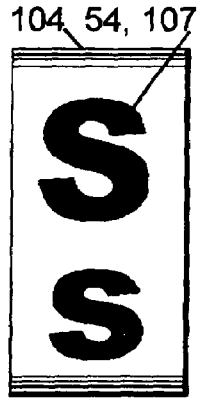
FIG. 23 is a diagrammatic elevational view of a twentieth playing piece taken generally in the direction of arrow F in FIG. 2 and of the ninth playing piece taken generally in the direction of arrow R in FIG. 2.

The front indicia 52 of a ninth playing piece 104 of the twenty-eight playing pieces 42 is an upper case and a lower case "H/h" 106 (FIG. 12), while the rear indicia 54 of the ninth playing piece 104 of the twenty-eight playing pieces 42 is an upper case and a lower case "S/s" 107 (FIG. 23).

Figure 22:
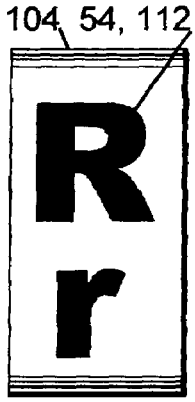
FIG. 22 is a diagrammatic elevational view of a nineteenth playing piece taken generally in the direction of arrow F in FIG. 2 and of the tenth playing piece taken generally in the direction of arrow R in FIG. 2.

The front indicia 52 of a tenth playing piece 108 of the twenty-eight playing pieces 42 is an upper case and a lower case "I/i" 110 (FIG. 13), while the rear indicia 54 of the tenth playing piece 108 of the twenty-eight playing pieces 42 is an upper case and a lower case "R/r" 112 (FIG. 22).

Figure 21:
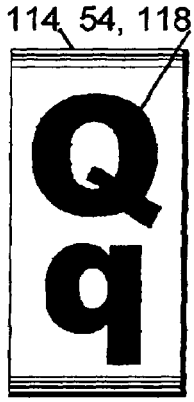
FIG. 21 is a diagrammatic elevational view of a eighteenth playing piece taken generally in the direction of arrow F in FIG. 2 and of the eleventh playing piece taken generally in the direction of arrow R in FIG. 2.

The front indicia 52 of an eleventh playing piece 114 of the twenty-eight playing pieces 42 is an upper case and a lower case "J/j" 116 (FIG. 14), while the rear indicia 54 of the eleventh playing piece 114 of the twenty-eight playing pieces 42 is an upper case and a lower case "Q/q" 118 (FIG. 21).

Figure 20:
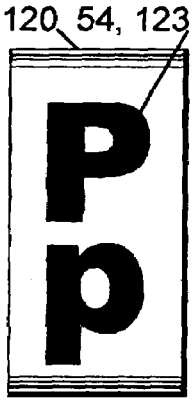
FIG. 20 is a diagrammatic elevational view of a seventeenth playing piece taken generally in the direction of arrow F in FIG. 2 and of the twelfth playing piece taken generally in the direction of arrow R in FIG. 2.

The front indicia 52 of a twelfth playing piece 120 of the twenty-eight playing pieces 42 is an upper case and a lower case "K/k" 122 (FIG. 15), while the rear indicia 54 of the twelfth playing piece 120 of the twenty-eight playing pieces 42 is an upper case and a lower case "P/p" 123 (FIG. 20).

Figure 19:
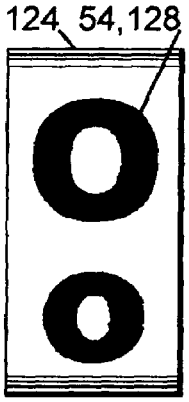
FIG. 19 is a diagrammatic elevational view of a sixteenth playing piece taken generally in the direction of arrow F in FIG. 2 and of the thirteenth playing piece taken generally in the direction of arrow R in FIG. 2.

The front indicia 52 of a thirteenth playing piece 124 of the twenty-eight playing pieces 42 is an upper case and a lower case "L/l" 126 (FIG. 16), while the rear indicia 54 of the thirteenth playing piece 124 of the twenty-eight playing pieces 42 is an upper case and a lower case "O/O" 128 (FIG. 19).

Figure 18:
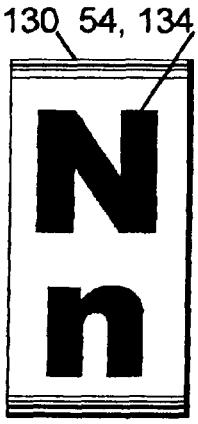
FIG. 18 is a diagrammatic elevational view of a fifteenth playing piece taken generally in the direction of arrow F in FIG. 2 and of the fourteenth playing piece taken generally in the direction of arrow R in FIG. 2.

The front indicia 52 of a fourteenth playing piece 130 of the twenty-eight playing pieces 42 is an upper case and a lower case "M/m" 132 (FIG. 17), while the rear indicia 54 of the fourteenth playing piece 130 of the twenty-eight playing pieces 42 is an upper case and a lower case "N/n" 134 (FIG. 18).

The front indicia 52 and the rear indicia 54 of a thirteen playing piece to a twenty-sixth playing piece of the twenty-eight playing pieces 42 are the reverse of the front indicia 52 and the rear indicia 54 of the second playing piece 64 to the fourteenth playing piece 130 of the twenty-eight playing pieces 42, respectively, i.e., the front indicia 52 of the fifteenth playing piece to the twenty-sixth playing piece of the twenty-eight playing pieces 42 is the rear indicia 54 of the second playing piece 64 to the fourteenth playing piece 130 of the twenty-eight playing pieces 42, respectively, and the rear indicia 54 of the fifteenth playing piece to the twenty-sixth playing piece of the twenty-eight playing pieces 42 is the front indicia 52 of the second playing piece 64 to the fourteenth playing piece 130 of the twenty-eight playing pieces 42, respectively.

In other words there are two of a kind of a total of fourteen different kinds of play pieces described in this specification. It is to be realized that others may devise different rules for playing different games with different numbers of kinds of playing pieces without departing from the spirit of the present invention.

The method of playing the word-forming game 10 can best be seen in FIGS. 1 and 31A-31*d*, and as such, will be discussed with reference thereto.

STEP 1: Align the twenty-eight playing pieces 42, twenty-six in alphabetical order and two "joker stars", on the playing field 51, between the one player and the opponent player, so as to form aligned playing pieces.

STEP 2: Announce, by a first player, so as to form an announced first player, a word to be spelled from the aligned playing pieces.

STEP 3: Remove, by the announced first player, playing pieces from the aligned playing pieces that spell the word announced, so as to leave remaining aligned playing pieces.

STEP 4: Determine, by a next player, if there are sufficient playing pieces remaining in the remaining playing pieces to form another word.

STEP 5: Win game by last player, if answer to step 4 is no.

STEP 6: Announce, by the next player, so as to form an announced next player, a word to be spelled from the remaining aligned playing pieces, if answer to step 4 is yes.

STEP 6: Remove, by the announced next player, playing pieces of the remaining aligned playing pieces that spell the word announced, if step 5 is carried out.

STEP 7: Return to step 4, if step 6 is carried out.

It will be understood that each of the elements described above, or two or more together, may also find a useful application in other types of constructions differing from the types described above.

While the invention has been illustrated and described as embodied in a word-forming game for at least two players and apparatus therefor, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A method of playing a word-forming game for at least two players, wherein the game has twenty-eight playing pieces, said method comprising the steps of:

a) aligning the twenty-eight playing pieces, twenty-six in alphabetical order and two "joker star", on a playing field, between one player and an opponent player, so as to form aligned playing pieces;

b) announcing, by a first player, so as to form an announced first player, a word to be spelled from the aligned playing pieces;

c) removing, by the announced first player, playing pieces from the aligned playing pieces that spell the word announced, so as to leave remaining aligned playing pieces;

d) determining, by a next player, if there are sufficient playing pieces remaining in the remaining playing pieces to form another word;

e) winning game by last player, if answer to step d) is no;

f) announcing, by the next player, so as to form an announced next player, a word to be spelled from the remaining aligned playing pieces, if answer to step d) is yes;

g) removing, by the announced next player, playing pieces of the remaining aligned playing pieces that spell the word announced, if step f) is carried out; and h) returning to step d), if step g) is carried out.

* * * * *